US005282772A

United States Patent [19]

Ninomiya et al.

[11] Patent Number: 5,282,772

[45] Date of Patent: Feb. 1, 1994

[54] SIMULATOR FOR SHOOTING DOWN THE RAPIDS

[75] Inventors: Shozo Ninomiya; Takashi Maeda, both of Kobe, Japan

[73] Assignee: Mitsubishi Jukogyo Kabushiki Kaisha, Tokyo, Japan

[21] Appl. No.: 959,360

[22] Filed: Oct. 13, 1992

[30] Foreign Application Priority Data

Oct. 17, 1991 [JP] Japan ..... 3-084603[U]
Oct. 28, 1991 [JP] Japan ..... 3-281529

[51] Int. Cl.[5] ..... A63G 31/16

[52] U.S. Cl. ..... 472/59; 472/60; 472/117; 472/128; 104/73

[58] Field of Search ..... 472/59, 60, 61, 13, 472/117, 128; 104/73, 83, 84, 86

[56] References Cited

U.S. PATENT DOCUMENTS

| | | | |
|---|---|---|---|
| 3,404,635 | 10/1968 | Bacon et al. | 472/13 |
| 3,930,450 | 1/1976 | Symons | 472/13 |
| 4,874,162 | 10/1989 | Trumbull et al. | 472/60 |
| 4,879,849 | 11/1989 | Hollingsworth, III et al. | 472/60 |
| 5,033,392 | 7/1991 | Schemitsch | 104/73 |
| 5,219,315 | 6/1993 | Fuller et al. | 472/128 |

FOREIGN PATENT DOCUMENTS

| | | |
|---|---|---|
| 63-502009 | 8/1988 | Japan . |
| 1-244783 | 9/1989 | Japan . |
| 2-4399 | 1/1990 | Japan . |
| 2-154782 | 6/1990 | Japan . |
| 3-51076 | 3/1991 | Japan . |

*Primary Examiner*—Carl D. Friedman
*Assistant Examiner*—Kien Nguyen
*Attorney, Agent, or Firm*—Nixon & Vanderhye

[57] ABSTRACT

In the simulator for shooting down the rapids in accordance with the present invention, a platform is installed on one side of a water channel in which a boat moves, and a theater zone is installed on the other side. In the theater zone, a boat swaying device and a wind generating device are installed, and these devices are successively operated in synchronization with the picture projected on a screen in the theater zone by a projector. Also, according to the present invention, three spherical seats are arranged in an isosceles triangle form under the boat moving in the water channel, and three vertically movable swaying rods are installed under the water channel in the theater zone at the positions corresponding to the spherical seats.

5 Claims, 9 Drawing Sheets

SIMULATOR FOR SHOOTING DOWN THE RAPIDS

FIELD OF THE INVENTION AND RELATED ART STATEMENT

The present invention relates to a simulator for shooting down the rapids which is used in a place of amusement, a training facility or the like.

In most of conventional amusement facilities on the water, a channel in which a boat moves is installed and many facilities for false experience gained on the boat are installed in the channel. In many cases the boat floats and moves along the channel and the spectators watch the facilities installed along the channel.

OBJECT AND SUMMARY OF THE INVENTION

The conventional amusement facilities on the water was not quite satisfactory because the boat floats and moves only along the channel and the spectators watch only the facilities along the channel, leading to the lack of spectators' feeling of experience.

Accordingly, the present invention was carried out to solve this problem, and an object of the present invention is to provide a simulator for shooting down the rapids which gives the spectators false experience in a real mode.

To attain the above object, a water channel in which a boat moves is installed, and a platform is installed on one side of the water channel, and a theater zone is installed on the other side. In the theater zone, a boat swaying device and a wind generating device are disposed, and these devices are successively operated in synchronization with the picture projected on a screen in the theater zone by a projector.

Also, according to the present invention, to attain the above object, a water channel is installed between the theater zone and the platform, three spherical seats are arranged in an isosceles triangle form under the boat moving in the water channel, and three vertically movable swaying rods are installed under the water channel in the theater zone at the positions corresponding to the spherical seats.

According to the present invention, the boat detachably engages with a carriage which moves on rails installed on the bottom of the water channel.

Therefore, according to the present invention, spectators get on the boat at the platform, and the boat is moved to the theater zone. In the theater zone, the boat is swayed by a boat swaying device in synchronization with the picture projected on the screen, and wind and water splash are generated by the wind generating device and a water spraying device, by which false experience of shooting down the rapids can be gained in a real mode.

Also, according to the present invention, three swaying rods, which are installed through the water channel bottom base in the theater zone, are vertically moved independently, and the boat is swayed with the swaying rods used as supporting points by engaging the swaying rods with three spherical seats installed under the boat.

DETAILED DESCRIPTION OF PREFERRED EMBODIMENTS

Figure 1:
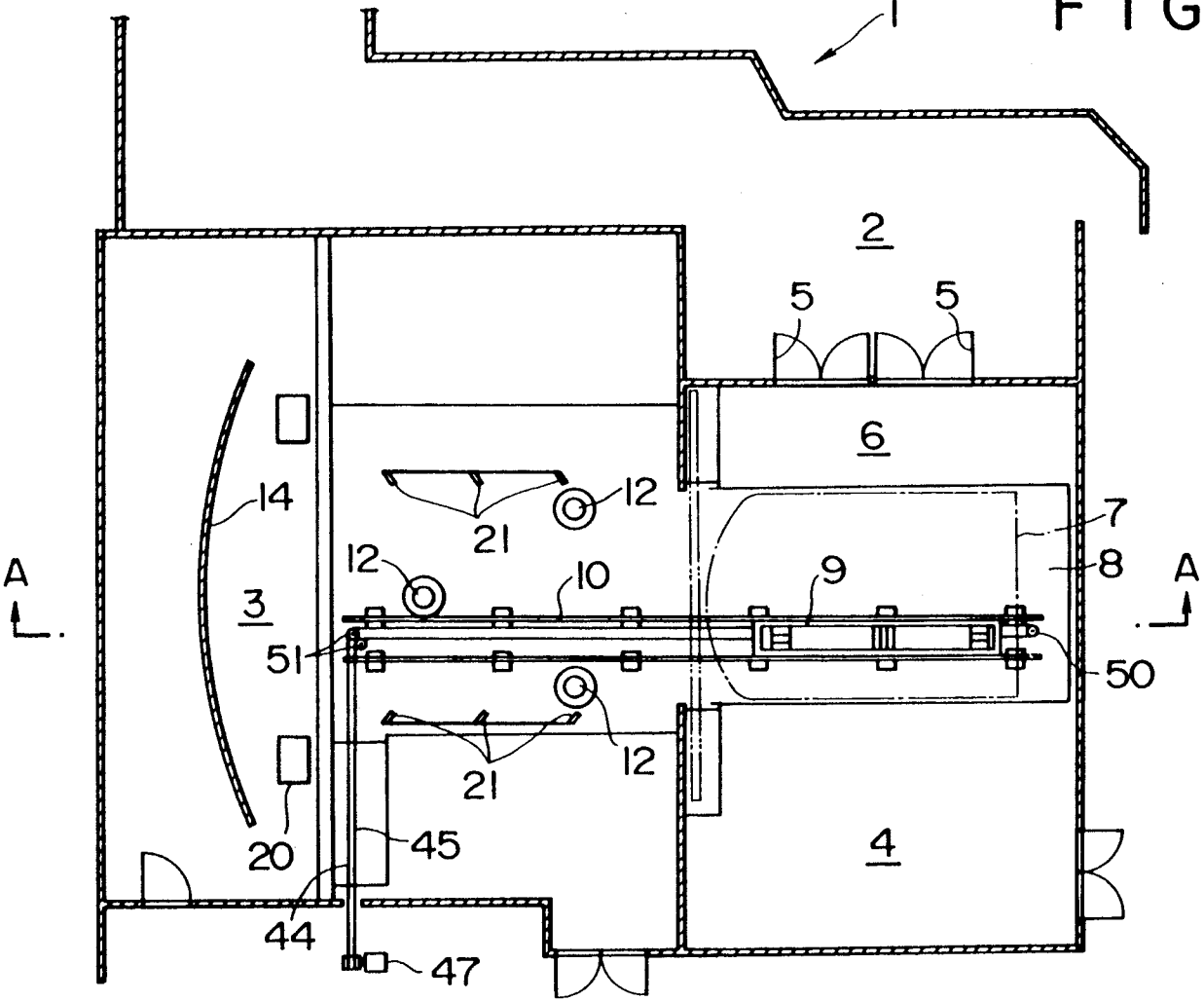
FIG. 1 is a plan view of an embodiment of the present invention, which is a sectional plan view taken on the plane of the line B—B of FIG. 2.
Figure 2:
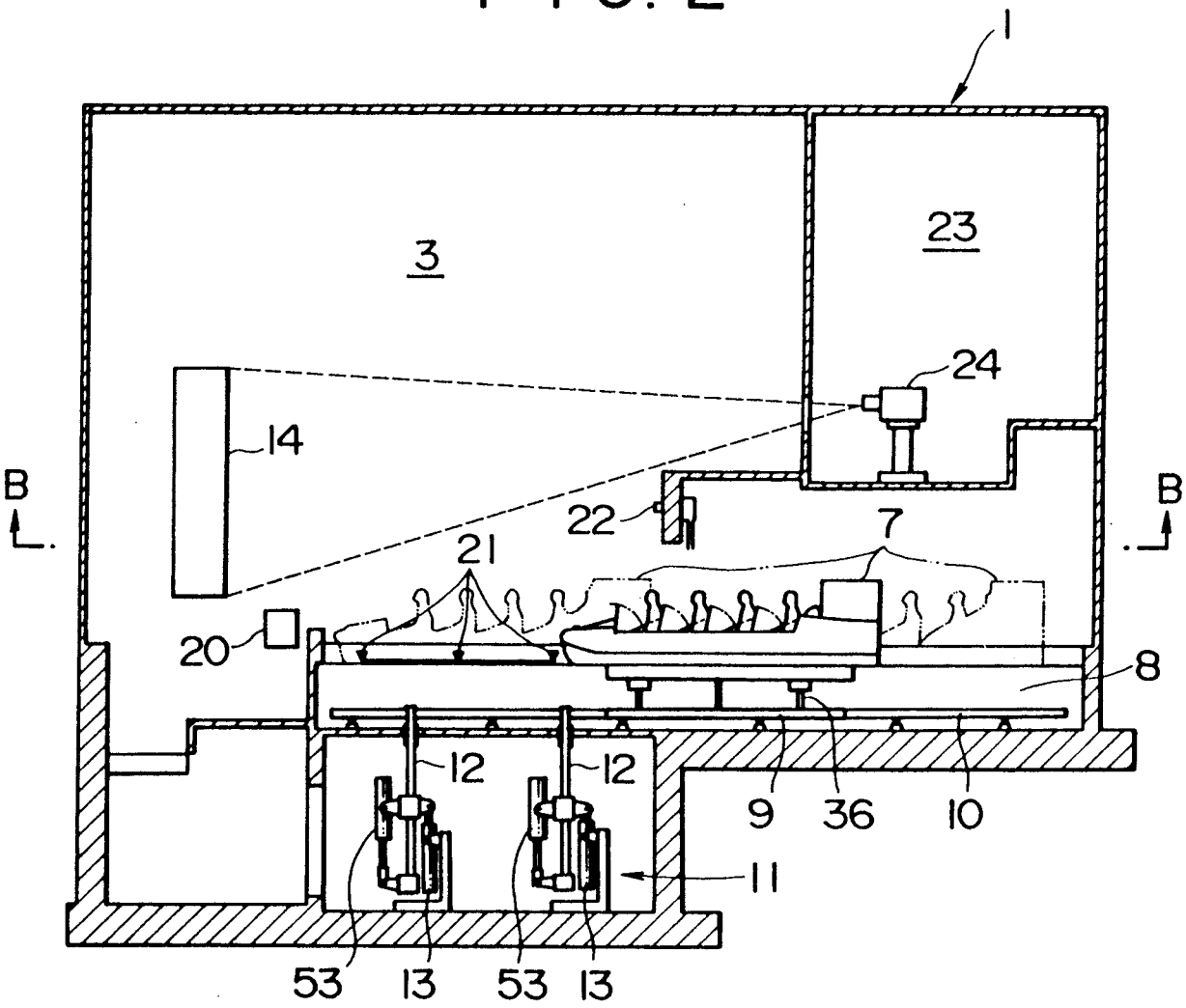
FIG. 2 is a sectional view taken on the plane of the line A—A of FIG. 1, showing a boat in motion.
Figure 3:
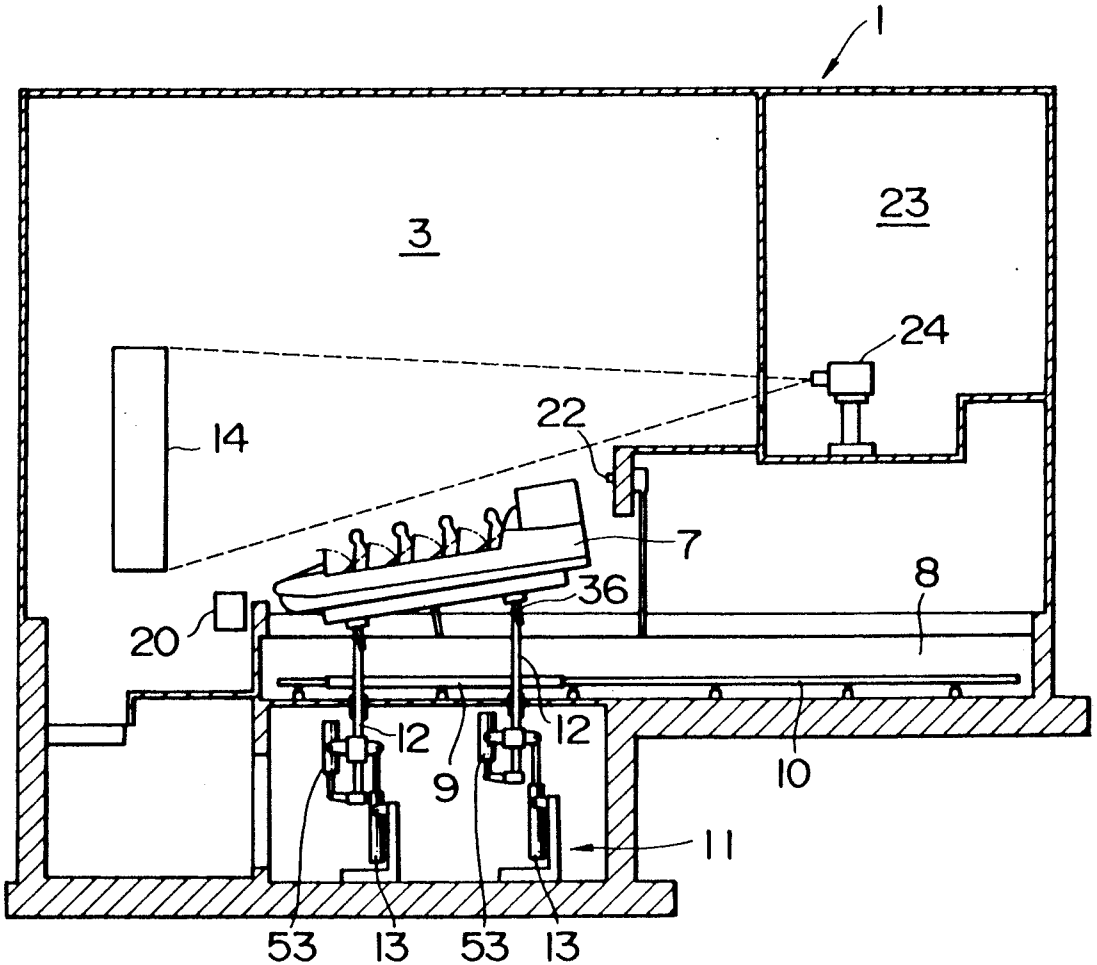
FIG. 3 is a sectional view taken on the plane of the line A—A of FIG. 1, particularly showing a swayed boat.

An embodiment of the present invention will be described with reference to FIGS. 1 through 12. Referring to FIG. 1, the amusement facility 1 on the water has three zones: a preshow zone 2, a theater zone 3, and after-show zone 4. The preshow zone 2 is adjacent to a platform 6 via entrance doors 5. A water channel 8 is installed between the platform 6 and the theater zone 3. In the water channel 8, a carriage 9 which is connected a boat 7 via rods 36, rails 10 on which the carriage runs, and a swaying device 11 for swaying the boat 7 are installed as shown in FIGS. 2 and 3.

In FIG. 1, the boat which spectators get on board at the platform 6 is moved to the theater zone 3 in the water channel by pulling the carriage 9 on the rails 10 with wires 44, 45.

Figure 4:
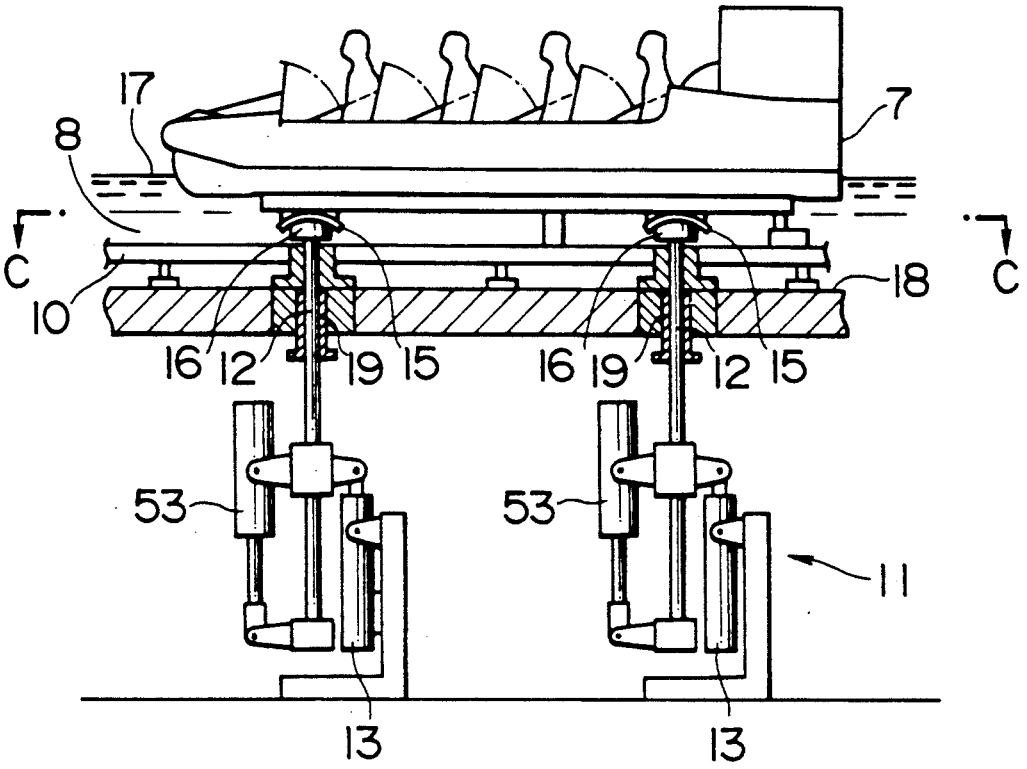
FIG. 4 is an expanded view of a swaying device.
Figure 5:
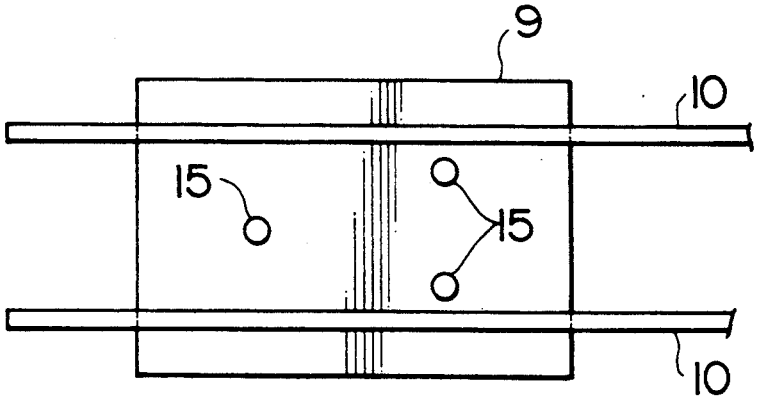
FIG. 5 is a plan view taken in the direction of the arrows along the line C—C of FIG. 5.
Figure 6:
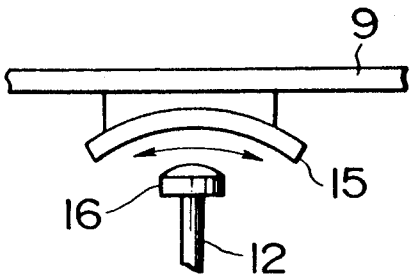
FIG. 6 is a side view of a spherical seat of FIG. 4.

The swaying device 11, installed in a machinery room positioned under the water channel in the theater zone 3, is provided with three swaying rods 12 having a spherical tip end and hydraulic lift cylinders 13 for moving the rods vertically as shown in FIGS. 4, 5, and 6.

The above-described three swaying rods are positioned at the vertexes of an isosceles triangle. Corresponding to these positions, three spherical seats 15 are installed under the boat 7. When the boat 7 is inclined, the horizontal distance between the spherical seats changes, allowing the contact point between the rod 12 and the spherical seat 15 to move.

Thus, the swaying device 11 can transmit a swaying motion to the boat 7 by engaging a convex seat 16 installed at the tip end of rod 12 with the spherical seat 15 installed on the carriage 9.

In FIG. 4, reference numeral 17 denotes the water surface, 18 denotes a water channel bottom base, 19 denotes a sealing means for providing seal between the swaying rod 12 and the water channel bottom base 18.

The theater zone 3 is provided with a wind generating device 20, a water spraying device 21, a water jet device 22, and a screen 14 as shown in FIGS. 1 and 2. On the screen 14, a picture is projected from a projector 24 installed in a projection room 23. Synchronizing with this picture, the boat 7 is swayed by the swaying device 11 or the carriage 9 is moved back and forth along the rails 10 to move the boat 7 horizontally, and the wind generating device 20, the water spraying device 21, and the water jet device 22 are operated successively to give the spectators false experience of shooting down the rapids.

Specifically, the boat 7 is moved together with the movement of the carriage 9 by a moving device 35 (refer to FIG. 8), which will be described later, and reaches a predetermined position in the theater zone 3, then being pushed up by the rods 12 via spherical seats 6. Therefore, the boat 7 leaves the carriage 9, and is swayed in synchronization with the picture projected on the screen 14, which gives the spectators false experience.

After the swaying ends, the rods 12 are lowered, and the boat 7 is engaged again with the carriage 9 via the rods 36. The boat 7 is moved from the theater zone 3 to the platform 6 by the movement of the carriage 9.

Figure 7:
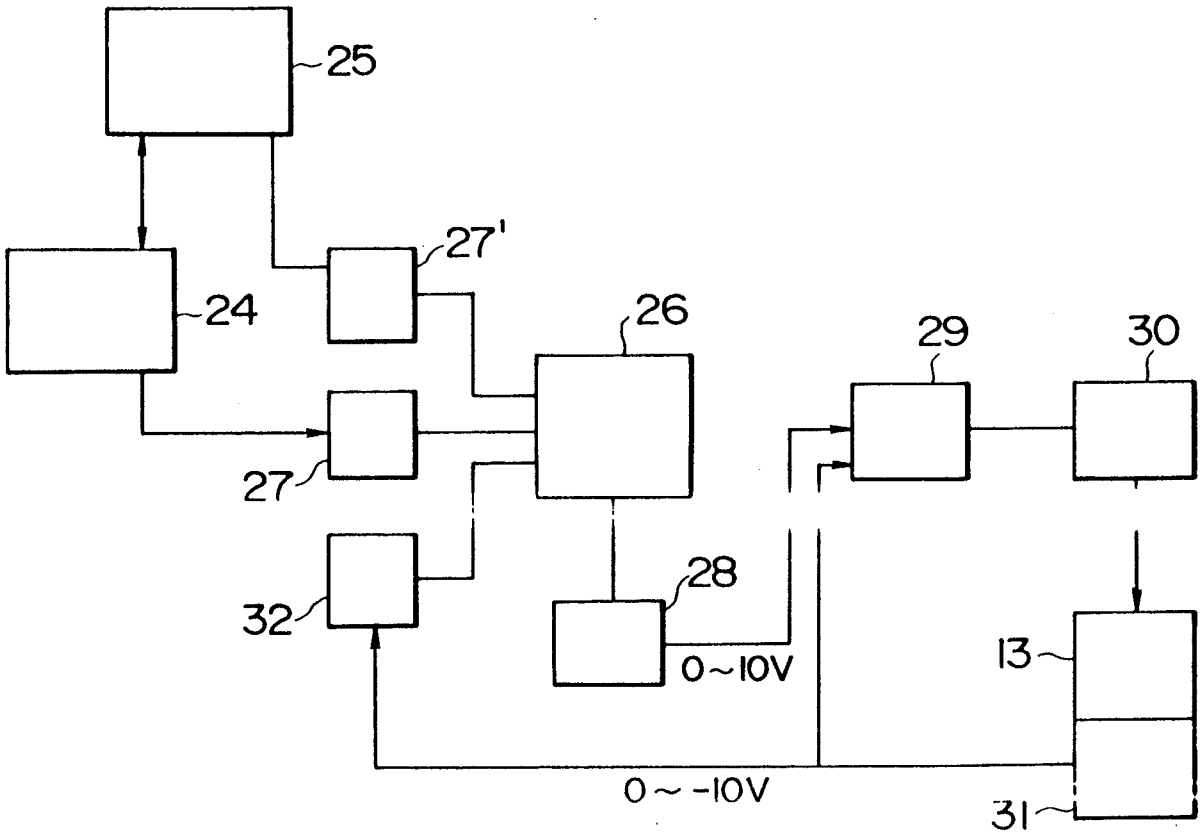
FIG. 7 is a block diagram showing the control system of a simulator in accordance with the present invention.

FIG. 7 shows the control system for driving the hydraulic cylinders in synchronization with the picture.

When a start signal is sent to the projector 24 and a computer 26 for controlling analog signals from a programmable logic controller (PLC) 25 which controls the entire system, the projector 24 starts to operate, and at the same time sends synchronization pulses equal to the number of picture frames to a counter unit 27 connected to the computer 26 for controlling analog signals. When the computer 26 for controlling analog signals receives a start signal through a digital input output (DI/O) unit, the computer 26 becomes in the condition of receiving the synchronization pulses. When a synchronization pulse comes, a 0–10 V analog signal corresponding to the current picture frame is sent to a servo amplifier 29 through a D/A converter 28. The servo amplifier 29 outputs servo current in proportion to this analog signal to a servo valve 30 to control the hydraulic lift cylinder 13. The lift cylinder 13 has a stroke sensor 31, which gives feedback to the servo amplifier 29. At the same time, the signal from the stroke sensor 31 is sent to the computer 26 for controlling analog signals through an A/D converter 32. The displacement and deflection of lift cylinder 13 are displayed on a cathode ray tube (CRT) in real-time, so that the displacement and deflection are monitored.

The moving device 35 for boat 7 will be described with reference to FIGS. 8 through 12.

Figure 10:
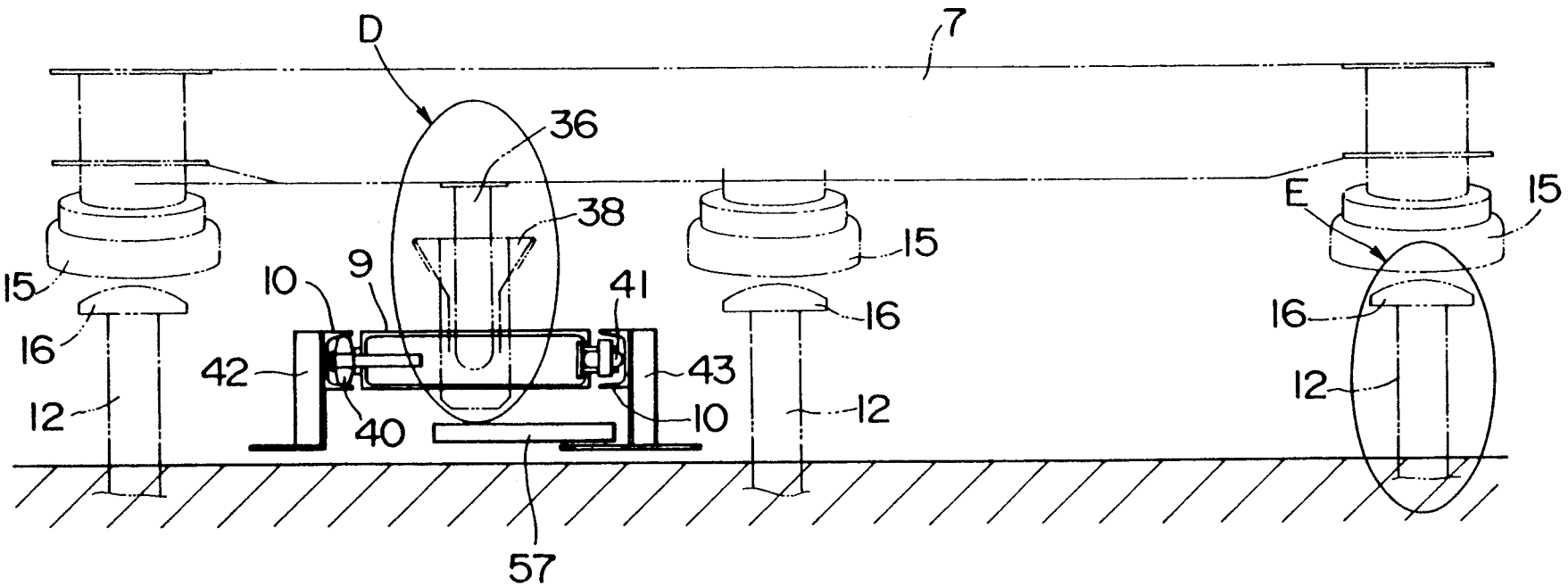
FIG. 10 is a schematic view of connecting means for connecting a boat to a carriage in an embodiment of the present invention.
Figure 11:
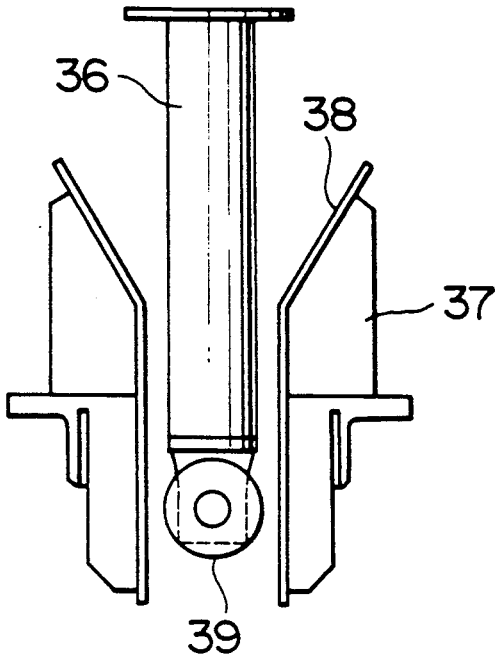
FIG. 11 is a detail view of the portion encircled with an ellipse and indicated by the arrow D.
Figure 12:
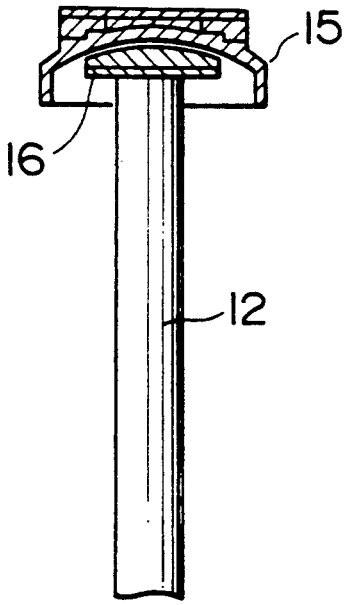
FIG. 12 is a detail view of the portion encircled with an ellipse and indicated by the arrow E.

The boat 7 is connected to the carriage 9 via connecting rods 36, and floats on the water surface by its buoyancy. The connecting rod 36 is installed to the bottom surface of boat 7, and inserted into and removed from the receiving hole 38 of connecting member 37 on the carriage 9, with a gap between the connecting rod 36 and the receiving hole 38 as shown in FIGS. 10 and 11.

The receiving hole 38 is formed with a C-shaped opening so that the connecting rod 36 can easily aligned. At the tip end of the connecting rod 36, a roller 39 is installed so that the tip end of connecting rod 36 can easily be inserted into or removed from the receiving hole 38 even if the tip end of connecting rod 36 is caught by the entrance of receiving hole 38 during the time when the connecting rod 36 is engaged with or disengaged from the connecting member 37.

When the connecting rod 36 of the boat 7 is inserted into the receiving hole 38, the horizontal movement of the boat 7 is restricted, but the boat 7 can be freely moved in the vertical direction. Therefore, the boat 7 sways during traveling as with an actual ship, and in swaying operation, only the boat 7 can be swayed, separating from the carriage 9.

The traveling wheel 40, 41 of the carriage 9 is grasped by the guide groove of guide rail 10 installed on a rail support 42, 43. The carriage 9 can be moved along the guide rails 10 via the first and second wires 44, 45, a support 46, and electric winch 47 as shown in FIG. 8.

The electric winch 47 is driven by the command of a computer (not shown) to move the carriage 9 via wires 44, 45. The positioning of the carriage 9 is performed by an encoder (not shown) installed on the electric winch 47 and a proximity switch (not shown) installed on the guide rail 10.

Figure 8:
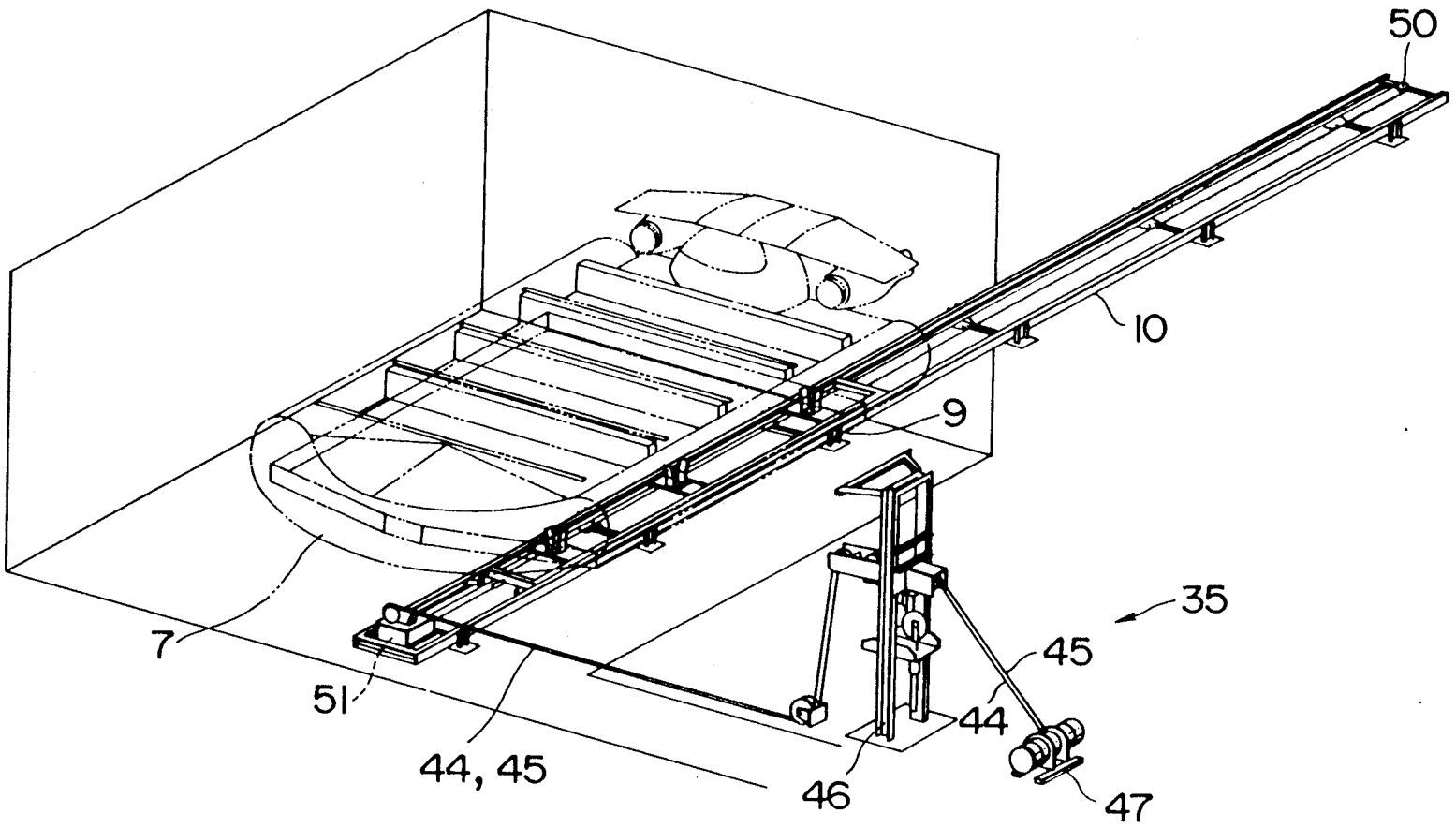
FIG. 8 is a perspective view of a moving device of an embodiment of the present invention.

The first wire 44 is wound around a first sheave 50 installed at the end of guide rail 10 on the platform 6 side and a second sheave 51 installed at the end of guide rail 10 on the theater zone 3 side as shown in FIG. 8. One end of the first wire 44 is attached to the rear end of the carriage 9, and the other end is wound around a first sheave 50 and also wound around the winch drum 48 of the electric winch 47. The second wire 45 is wound around the second sheave 51, one end of which is attached to the front end of the carriage 9, and the other end is wound around the second sheave 51 and also wound around the winch drum 48 of the electric winch 47. The winch drum 48 is designed so as to let out one of either the first wire 44 or the second wire 45 and at the same time roll up the other.

Figure 9:
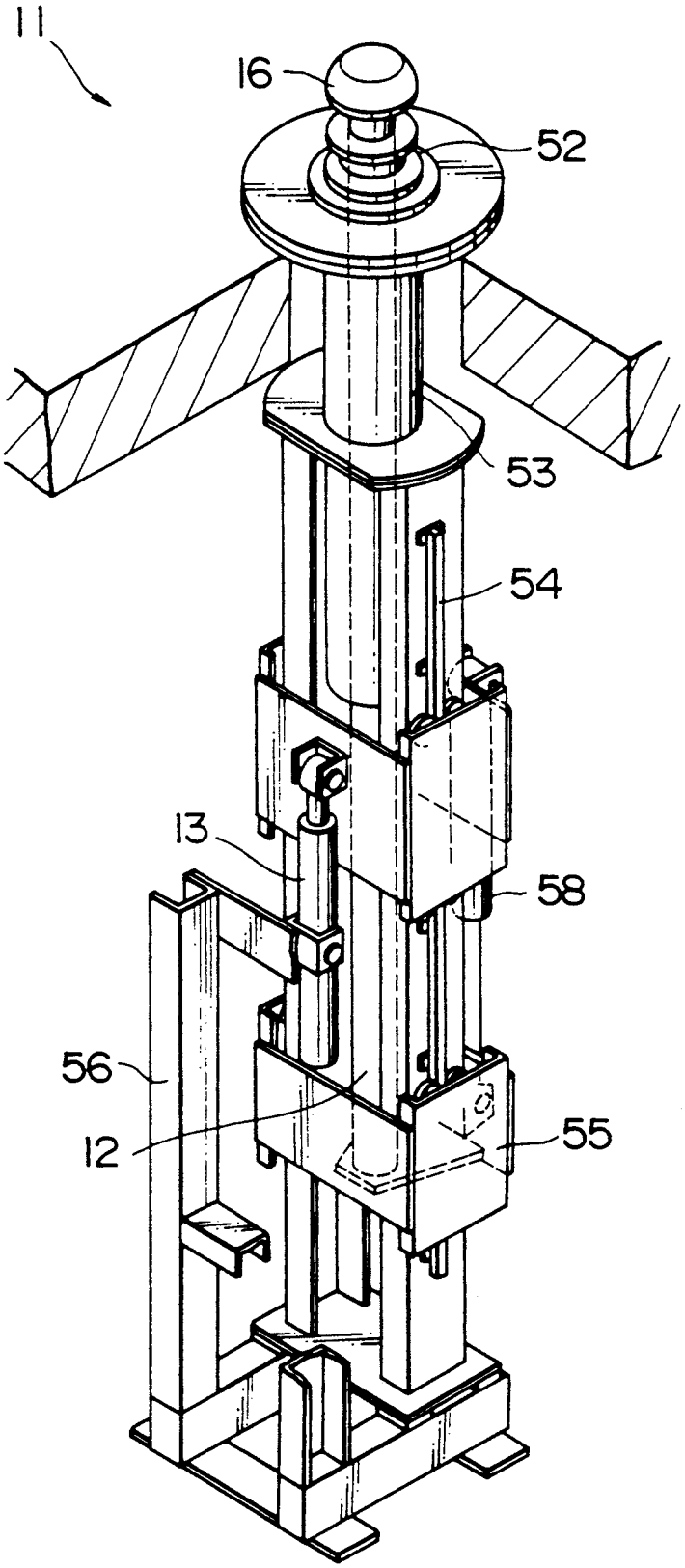
FIG. 9 is a perspective view of a swaying device of an embodiment of the present invention.

FIG. 9 shows the details of the swaying device 11, which has the rod 12, the lift cylinder 13, and the convex seat 16. Reference numeral 52 denotes a packing, 53 denotes a bearing cylinder, 54 denotes a guide rail, 55 denotes a slide member, and 56 denotes a stay. FIG. 10 shows the positional relationship between the rod 12, the carriage 9, and the guide rails 10. In this figure, reference numeral 57 denotes a wire receiving member.

The swaying device 11, being installed in the machinery room under the water channel as described above, comprises a lift cylinder 13 for lifting the boat 7 from the water surface, a cylinder 58 for swaying the boat 7, and a rod 12 extending vertically in the water channel in connection with the cylinder. The swaying motion can be transmitted to the boat 7 by engaging the convex seat 16 installed at the tip end of the rod 12 with the spherical seat 15 installed on the lower surface of the carriage 9. The spherical seat 15 is larger than the convex seat 16, so that the change of horizontal distance is absorbed when the boat 7 is inclined. The end of the spherical seat 15 is of a cylindrical shape to prevent the convex seat 16 from coming off the spherical seat 15.

In swaying operation, the boat 7 is first lifted from the water surface for the boat 7 not to come into contact with the water. The boat 7 lifted from the water surface is inclined forward about 10° to let the spectators watch the picture easily and to give them a feeling of shooting down the rapids.

The boat 7 is swayed about 150 mm up and down and about +/−5° right and left from the condition of about 10° forward inclination.

The operation of hydraulic cylinders 13, 58 is performed by giving a command signal in synchronization with the picture from the computer to the servo valve (not shown) to control the flow of hydraulic oil.

As described above, in the simulator for shooting down the rapids in accordance with the present invention, the platform is installed on one side of the water channel in which the boat moves, and the theater zone is installed on the other side. In the theater zone, the boat swaying device and the wind generating device are installed, and these devices are successively operated in synchronization with the picture projected on the screen in the theater zone by the projector. Therefore, the boat sways in synchronization with the picture on the screen, and the spectators receive wind and water splash, so that the spectators on the boat gain false experience of shooting down the rapids in a real mode.

Also, according to the present invention, the water channel is installed between the theater zone and the platform, three spherical seats are arranged in an isosceles triangle form under the boat moving in the water channel, and three vertically movable swaying rods are installed under the water channel in the theater zone at the positions corresponding to the spherical seats. Therefore, the effect of false sway experience is exhanced by swaying the boat by the vertically movable swaying rods in synchronization with the picture projected on the screen. In addition, the effect of false experience can be further enhanced by moving the boat between the theater zone and the platform by engaging the boat with the carriage which moves on the rails installed on the water channel bottom base.

We claim:

1. A simulator for shooting down the rapids comprising, a theater zone in which a screen and wind generating device are installed in front and/or at the side thereof;

a platform for spectators;

a water channel which is disposed between said platform and said theater zone and has at least two rails installed on the bottom;

a boat which is floated in said water channel and has seats for spectators;

a carriage which moves on said rails along said water channel;

a connecting means which detachably connects said boat to said carriage;

a moving device which moves said carriage between said platform and said theater zone; and a swaying device which lifts from a predetermined position at the bottom of said theater zone and engages with the lower portion of said boat stopped over said swaying device to sway said boat;

wherein the spectators on said boat moved from said platform to said theater zone receive wind from the wind generating device in synchronization of the picture on said screen, and said boat is swayed to let spectators feel an ambience.

2. A simulator for shooting down the rapids according to claim 1, wherein the said swaying device comprises hydraulic cylinders arranged in an isosceles triangle form in a machinery room disposed under the water channel in said theater zone; vertically movable rods extending into the water channel in connection with said hydraulic cylinders; and convex seats which are installed at the tip ends of said rods and engage with spherical seats installed under said boat stopped over said convex seats.

3. A simulator for shooting down the rapids according to claim 1, wherein said connecting means which detachably connects said boat to said carriage comprises rods installed on the bottom of said boat; and connecting members having a plurality of receiving holes installed on said carriage to receive said rods.

4. A simulator for shooting down the rapids according to claim 1, wherein said moving device comprises a first sheave installed at the end of one said rails on the platform side; a second sheave installed at the end of the other said rails on the theater zone side; a first wire which is wound around said first sheave, one end of said first wire being attached to the rear end of said carriage and the other end being wound around said first sheave and also around a winch drum; and a second wire which is wound around said second sheave, one end of which being attached to the front end of said carriage and the other end being wound around said second sheave and also around said winch drum, whereby one of either the first wire or the second wire is let out and at the same time the other wire is rolled up by said winch drum.

5. A simulator for shooting down the rapids according to claim 1, wherein said simulator has a water spraying device which comprises a spraying nozzle installed in front of and/or at the side of said theater zone; a pump which sucks water in said water channel and supply it to said nozzle; and a spraying valve which is installed halfway in a pipe between said pump and said nozzle and carries out control so that water from said pump is sprayed from said nozzle in synchronization with the picture on said screen.

* * * * *